United States Patent [19]

Seki et al.

[11] Patent Number: 4,881,833

[45] Date of Patent: Nov. 21, 1989

[54] DRIVE MECHANISM FOR A SMALL-SIZED PRINTER

[75] Inventors: Mitsuaki Seki, Machida; Satoshi Watanabe, Chichibu; Hideaki Miyakawa, Yokohama, all of Japan

[73] Assignees: Cannon Kabushiki Kaisha; Cannon Denshi Kabushiki Kaisha, both of Tokyo, Japan

[21] Appl. No.: 186,678

[22] Filed: Apr. 21, 1988

Related U.S. Application Data

[60] Continuation of Ser. No. 85,327, Aug. 12, 1987, abandoned, which is a continuation of Ser. No. 831,593, Feb. 21, 1986, abandoned, which is a division of Ser. No. 779,316, Sep. 24, 1985, Pat. No. 4,589,787, which is a continuation of Ser. No. 732,799, May 10, 1985, abandoned, which is a continuation of Ser. No. 599,217, Apr. 13, 1984, abandoned, which is a continuation of Ser. No. 459,588, Jan. 20, 1983, abandoned, which is a continuation of Ser. No. 175,521, Aug. 5, 1980, abandoned.

[30] Foreign Application Priority Data

| | | | |
|---|---|---|---|
| Aug. 8, 1979 | [JP] | Japan | 54-101104 |
| Aug. 9, 1979 | [JP] | Japan | 54-101660 |
| Aug. 9, 1979 | [JP] | Japan | 54-101661 |
| Nov. 16, 1979 | [JP] | Japan | 54-148660 |

[51] Int. Cl.[4] ..... B41J 23/34

[52] U.S. Cl. ..... 400/185; 400/145.2; 400/568; 101/93.21

[58] Field of Search ..... 400/145.2, 146, 152, 400/185, 365, 370, 378, 568, 606, 607, 608.1, 617, 634, 636, 641; 101/93.13, 93.21, 93.22, 93.26, 93.28, 93.29, 93.32, 93.33, 93.34, 99, 106

[56] References Cited

U.S. PATENT DOCUMENTS

| | | | |
|---|---|---|---|
| 723,855 | 3/1903 | Frantz | 400/142.2 |
| 2,617,706 | 11/1952 | Jeffrey | 101/93.33 X |
| 3,589,494 | 6/1971 | Gloess | 101/93.26 X |
| 3,838,638 | 10/1974 | Clary | 101/93.34 X |
| 4,092,921 | 6/1978 | McInnis et al. | 101/93.21 |
| 4,494,885 | 1/1985 | Watanabe | 400/145.2 |
| 4,589,787 | 5/1986 | Seki et al. | 400/145.2 |
| 4,655,130 | 4/1987 | Kyogoku et al. | 101/93.23 |

FOREIGN PATENT DOCUMENTS

| | | |
|---|---|---|
| 2808322 | 8/1978 | Fed. Rep. of Germany . |
| 13129 | 4/1976 | Japan . |
| 51-115114 | 10/1976 | Japan . |
| 52-35718 | 9/1977 | Japan . |
| 133646 | 10/1977 | Japan . |
| 54-24731 | 8/1979 | Japan . |

OTHER PUBLICATIONS

IBM Technical Disclosure Bulletin vol. 18, No. 5, Oct. 1975, "Drum Printer", p. 1330, by Hall et al.

*Primary Examiner*—David A. Wiecking

*Attorney, Agent, or Firm*—Fitzpatrick, Cella, Harper & Scinto

[57] ABSTRACT

In a small-sized printer having hammers provided within a type ring according to the invention, a direction in which the hammer is moved is changeable over selectively so that printing may be carried out in different positions. Also, electronic apparatus is provided which has a hammer mechanism as well as a battery or motor mounted in the type ring so as to miniaturize the apparatus.

4 Claims, 14 Drawing Sheets

DRIVE MECHANISM FOR A SMALL-SIZED PRINTER

This application is a continuation of U.S. Ser. No. 07/085,327, which is a continuation of U.S. Ser. No. 07/831,593, which is a division of U.S. Ser. No. 06/779,316, now U.S. Pat. No. 4,589,787 which is a continuation of U.S. Ser. No. 06/732,799, which is a continuation of 06/599,217, which is a continuation of U.S. Ser. No. 06/459,588, which is a continuation of U.S. Ser. No. 06/175,521, all abandoned unless indicated otherwise.

BACKGROUND OF THE INVENTION

1. Field of the Invention

The present invention relates to a printer, and more particularly relates to a printer which is miniaturized in such a manner as to be advantageously adoptable for pocketable miniature electronic calculators, electronic translators etc., having LSIs mounted therein and which is improved so as to enable printing to be performed also on printing paper laid on a desk in a simple manner.

2. Description of the Prior Art

With the development of LSI technique in recent years there has been made remarkable advance in miniaturization of electronic desk calculators, translators, etc. Nowadays, a pocketable size of such small-sized electronic apparatus is available. In contrast, however, the miniaturization of printing apparatus has not yet been attained satisfactorily because of various technical problems to be solved. It is much more difficult to provide a printing apparatus which is simple in structure and which performs printing not only on a roll of printing paper but also on a sheet of printing paper on a desk.

SUMMARY OF THE INVENTION

Accordingly, it is a general object of the invention to solve the problems mentioned above.

It is a more specific object of the invention to miniaturize the above mentioned type of printer by positioning the printing hammer within the type ring and also by positioning as many as possible other electronic parts within the ring.

It is another object of the invention to provide a printer in which two or more different home positions can be set for the type ring so that printing in different positions may be carried out easily by the hammer.

BRIEF DESCRIPTION OF THE DRAWINGS

Those and further objects, features and advantages of the invention will appear more fully from the following description taken in connection with the accompanying drawings in which.

DESCRIPTION OF PREFERRED EMBODIMENTS

Figure 1:
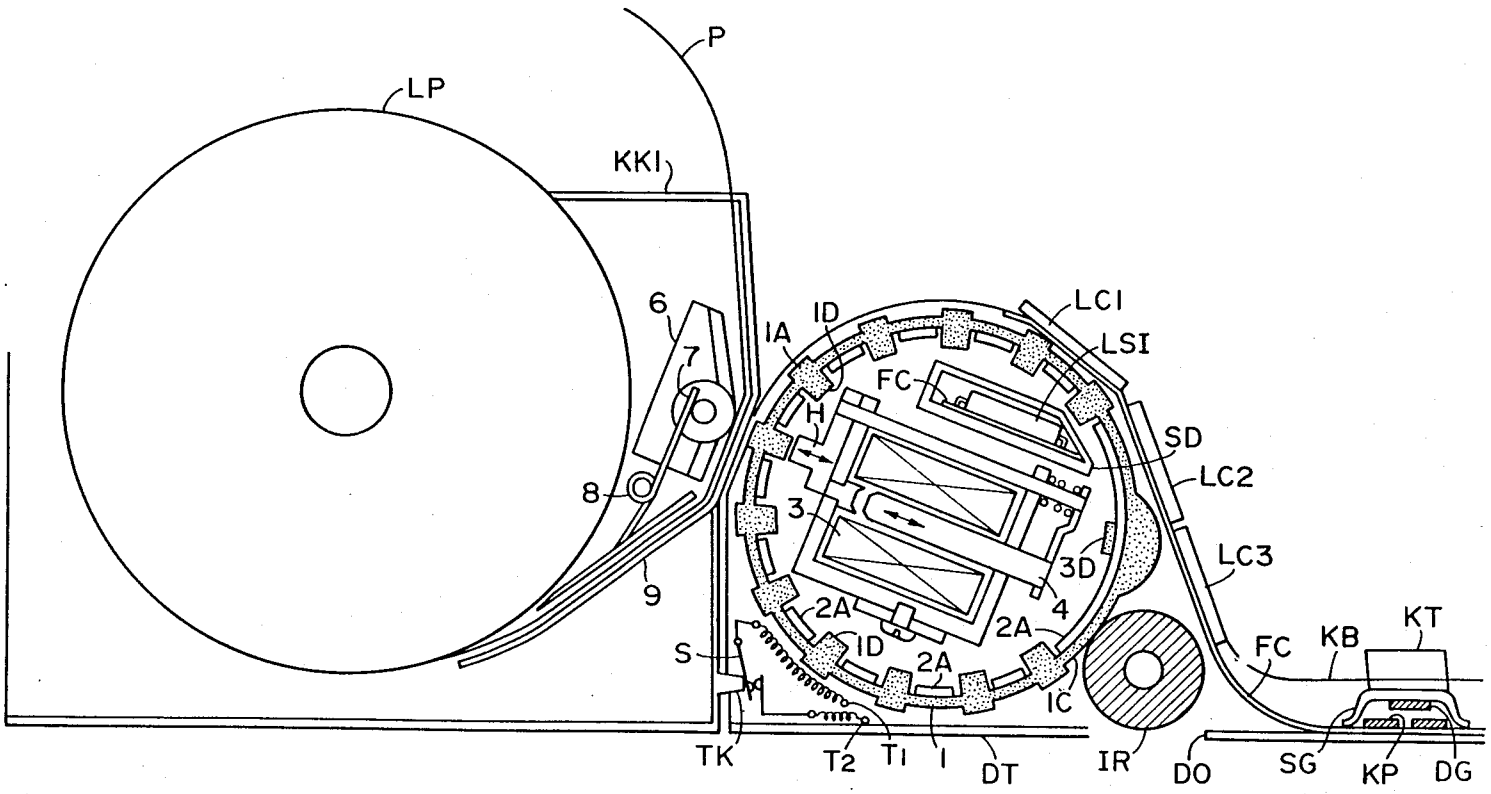
FIG. 1 shows an embodiment of the present invention.
Figure 2:
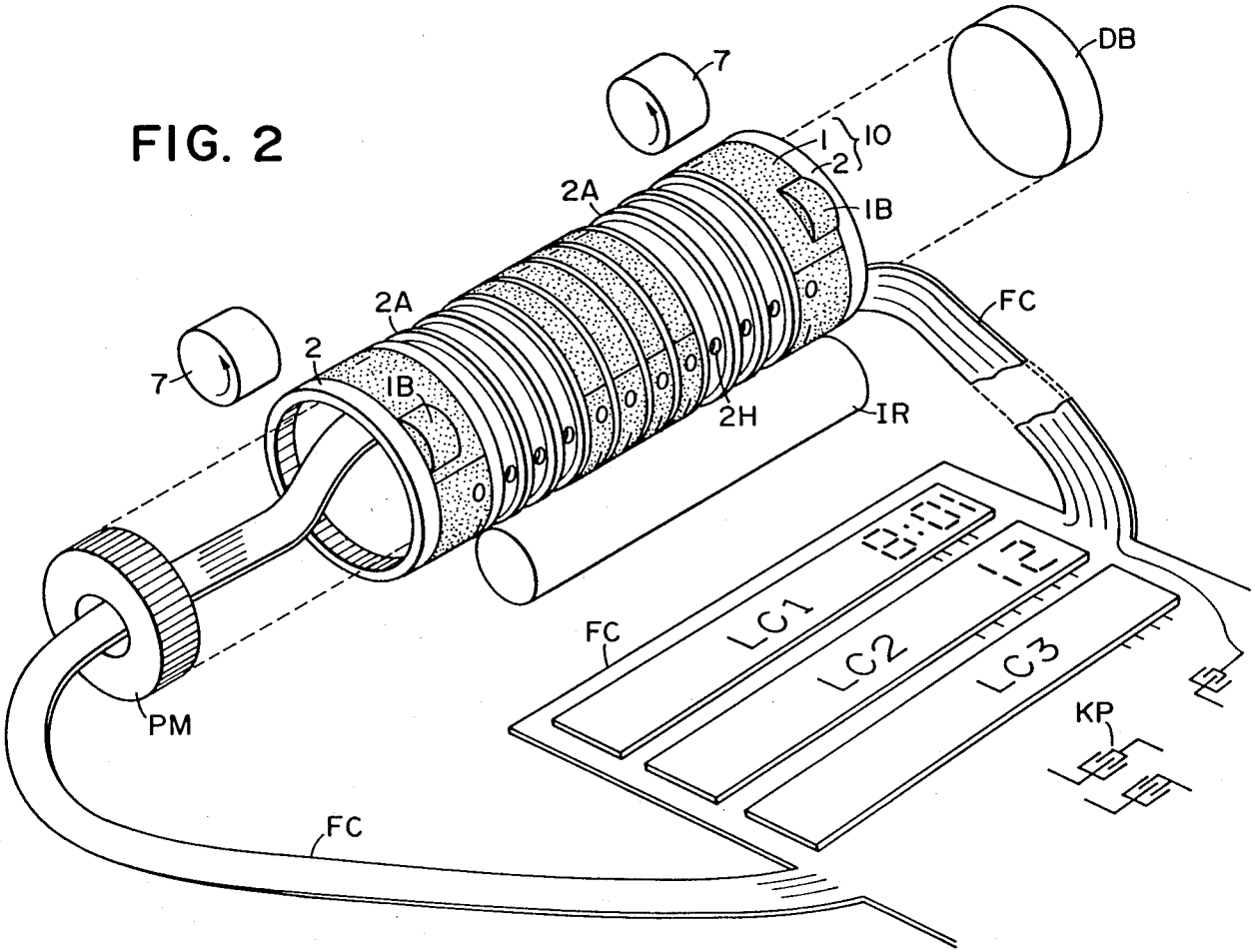
FIGS. 2 and 3 are fragmentary perspective views of the apparatus shown in FIG. 1.

Referring first to FIGS. 1 and 2 showing a preferred embodiment of the invention, the type ring unit generally designated by 10 comprises a type belt 1 and a cylindrical supporting member 2. The type belt 1 has a number of projections 1D on its back surface and the supporting cylinder 2 has a number of holes. The type belt is laid around the supporting cylinder with the projections 1D being fitted in the corresponding holes. The type ring unit 10 is rotated by a motor PM and a coin-shaped battery DB received in the ring. During one revolution of the type ring unit 10, characters to be printed are selected and the corresponding types 1A are protruded toward printing paper P by a printing hammer 4 which strikes the projections 1D. The protruded types 1A come into contact with the printing paper P and the ink applied to the types 1A by an ink roller IR is transferred onto the printing paper to effect printing.

The type ring unit 10 has also a pair of protrusions 1B at the both side areas thereof laterally outside of the ink roller IR. The protrusions 1B come into contact with a pair of opposed pinch rollers 7 every time after one revolution of the type ring during which character selection is made and then one line of printing is completed. During the time of the protrusions 1B being in contact with the pinch rollers 7, the printing paper P2 which is guided by a platen (6) and paper guide 9, is driven into upward movement. As seen best in FIG. 3, the protrusions 1B are provided on the type belt 1, at the portion where no type 1A is formed. This portion is predetermined in conformity with the timing at which the paper is transported after printing. The portion is connected with the remaining part of the type belt at the end part 1C.

Figure 3:
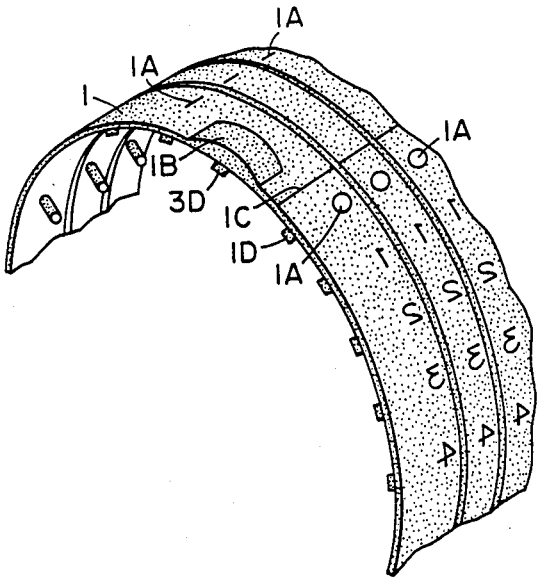

As shown in FIG. 3, type 1A, protrusion 1B and backside projection 1D of the type 1A are formed as an integrated member by using an elastic high molecular material such as NBR rubber silicone rubber or urethane rubber. Therefore, paper can be fed as desired without any slippage of paper by suitably setting the pinch rollers 7 and spring 8 pressing the rollers. The paper feed mechanism necessitates no complicated member, no large space and no particular arrangement. Since the paper feed mechanism is very simple in structure, the space which would otherwise be required for paper feed mechanism can be used to receive a coin-shaped battery and motor. This feature contributes to a further miniaturization of the printer.

In the prior art apparatus, the rubber roller for feeding paper remains always in contact with a pair of pinch rollers. Therefore, a particular mechanism was required to separate the pinch rollers from the paper feed roller at the time of paper changing. In addition, the printing paper was apt to get jammed when it was caught in between the paper guide and platen even a little during a printing motion and paper feeding motion. In contrast, according to the invention, the printing paper P is normally in slight contact with the paper guide 9 and platen 6 as seen in FIG. 1 and the pinch rollers 7 come into contact with the protrusions 1B only the time of paper feeding. Therefore, even when the paper P is caught a little between the guide 9 and platen 6, the position of paper can be corrected at once and there occurs no trouble of paper jamming.

Another merit derived from the above embodiment shown in FIG. 1 is that a switch S for detecting the paper cassette KK1 also can be positioned at the place which, in conventional apparatus, should have been taken by the rubber roller for paper feeding. This makes it possible to provide a small-sized desk calculator DT with a further miniaturized printer.

The battery DB received within the type ring unit can be used to drive not only a pulse motor PM but also liquid crystal displays LC1, LC2 and LC3 arithmetic chip LSI and key pattern KP. These driven elements are connected with each other by a flexibly printed circuit board FC. Since the printed circuit board FC is very thin and flexible, it is very useful for electrical connections between the hammer, battery, motor and other internal and external members. As shown in FIG. 1, the arithmetic chip LSI and other electronic parts also can be contained within the type ring unit and therefore the overall size of apparatus can be reduced to a great extent. By enclosing the arithmetic chip LSI with a shielding material SD, noise from the hammer solenoid can be prevented effectively. Also, a memory LSI may be used.

In the embodiment shown in FIG. 1, a plural number of liquid crystal display elements LC1, LC2, LC3 are provided around the type ring unit 10. This arrangement of liquid crystal display LC makes the display easily and conveniently visible for the operator. Also, it serves to miniaturize the apparatus. The hammer 4 is disposed upwardly inclined at an angle in the range of from 20° to 30° C. so that the operator can view the printed character at once.

Since the members present above the key pattern KP are only insulating rubber SG, electrically conductive rubber DG and key top KT, a very thin key board KB can be formed. Furthermore, since no driving source is required to be provided within the paper cassette KK for paper feed, a larger amount of rolled paper can be received therein. As previously mentioned, S is a switch for detecting the cassette.

Figure 4:
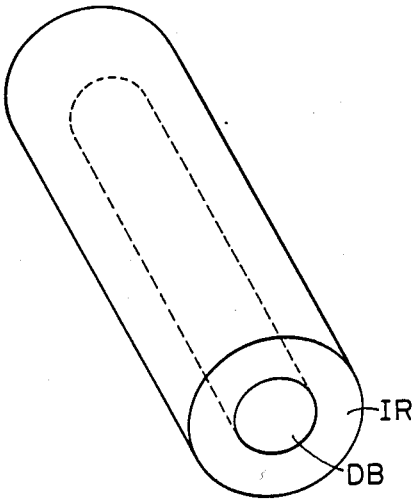
FIG. 4 shows a battery received in the ink roller.

FIG. 4 shows a modification of the above embodiment wherein the battery DB is received within the ink roller IR. According to the modification, exchange of an old ink roller for a new one and exchange of an old battery for a new one can be carried out at the same time by selecting the times of the exchanges to be concurrent. This is preferred since it saves labour and miniaturizes the apparatus. Also, in the modification, the space used for receiving the battery in the embodiment shown in FIG. 2 may be used to receive other electric components such as a miniature speaker.

Figure 5:
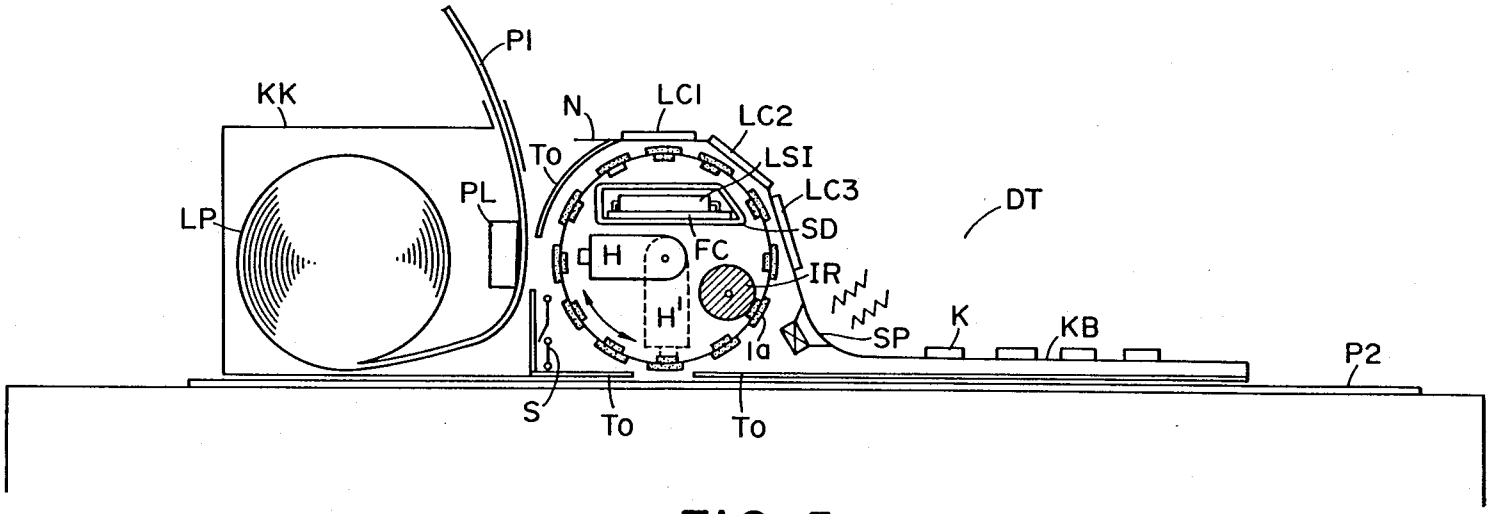
FIG. 5 shows another embodiment of the invention.

FIG. 5 shows another embodiment of the invention.

DT designates generally a small-sized desk electronic calculator, K is a key group and LC1–LC3 are numerical display elements formed by using, for example, liquid crystals. IR is an ink roller for supplying ink to types which are impregnated with ink. H designates a group of hammers contained within a type ring. The position of the hammer H can be switched over from one printing position to another. For example, when the hammer is changed over to the position suggested by H′, printing can be carried out on a sheet of paper P2 laid on a table. KK is a paper cassette in which a roll of paper P1 is contained. Types C are impregnated with ink and also allow the ink to move within the types. Therefore, the ink roller received in the type ring can supply ink to the types through the contact surface between the roller and type.

The paper cassette KK is detachable from the desk calculator DT. Whether the cassette KK is attached or detached is detected by a detection switch S, which comprises indicating means for providing an indication signal indicative of whether the cassette is mounted to the printer. The cassette detection switch S may be formed in such a manner that when the cassette is attached, the switch is turned on to keep the hammer H in the position indicated by the solid line and when detached it is turned off to keep the hammer in another position H′. It is also possible to change over the position of the hammer from H to H′ in response to an instruction signal applied by key K even when the paper cassette KK remains attached to the desk calculator DT.

Figure 6:
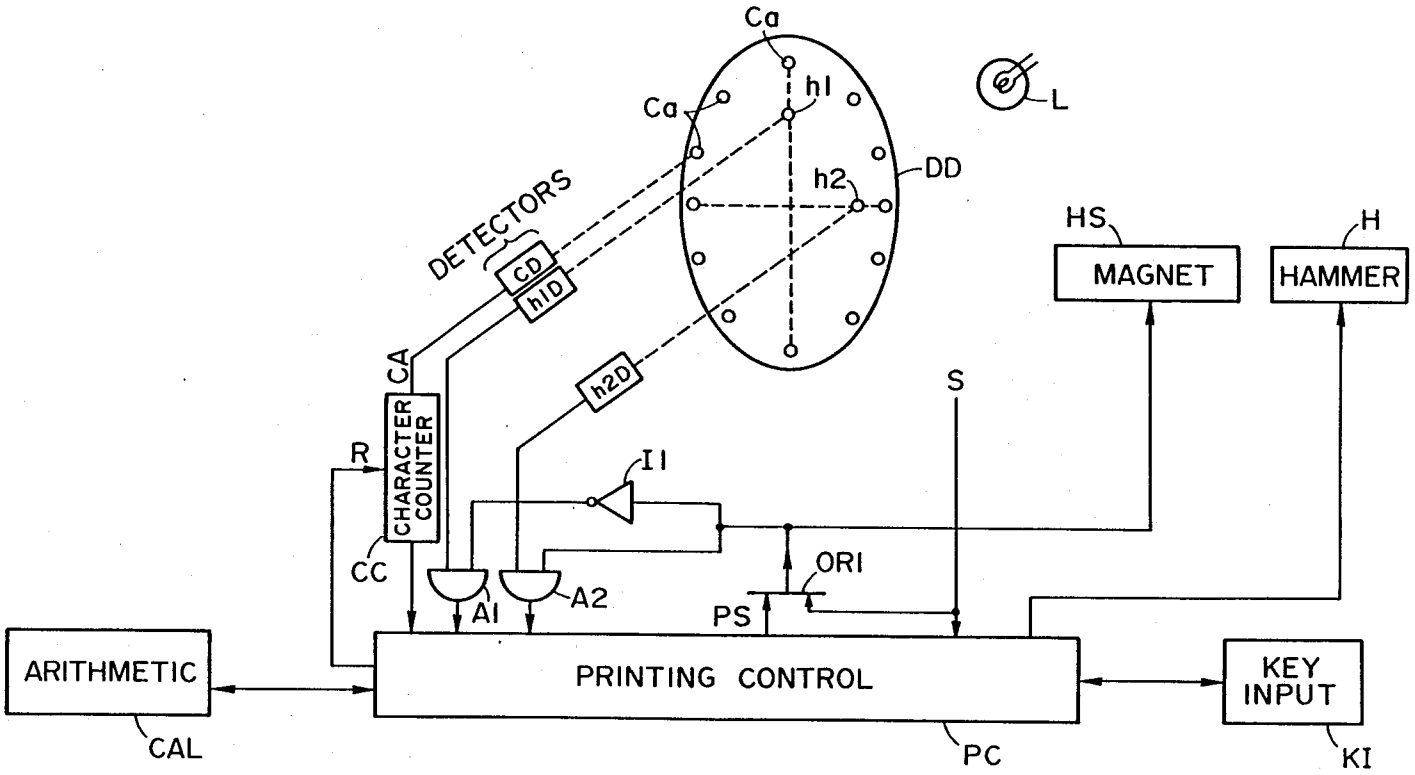
FIGS. 6, 7, 8 and 9 show some examples of driving circuitry used for the embodiments.

FIG. 6 shows a form of circuit useful for the embodiment in which the type drum is driven by a DC motor contained in the drum.

In this case, the above-mentioned LSI contained in the type ring comprises key input circuit KI, arithmetic unit CAL, printing control PC and other logical elements. Designated by L is a lamp, DD is a disk for generating a type position signal, CD, h1D, h2D are detectors and CC is a character counter. The signal generating disk DD has a number of holes of which holes Ca correspond to type positions respectively. The hole h1 is provided to inform PC of the first home position and hole h2 to inform PC of the second home position. Holes Ca, h1 and h2 are detected by the detectors CD, h1D and h2D respectively. The character counter CC counts character pulses CA derived from the detector CD. The function of character counter CC is to detect the character and position of the type. R indicates a reset input to character counter CC. Designated by HS is an electromagnet for changing over the position of hammer H. A1 and A2 are AND gates, I1 is an inverter and OR1 is an OR gate.

For the purpose of explanation, it is assumed that when the cassette KK is attached, the switch S is on and the output from OR gate OR1 is at its low level. In this position, the AND gate A1 is enabled and A2 is disabled. Therefore, the electromagnet HS is not energized and the hammer H is in the position indicated by the solid line in FIG. 5. In a manner known per se, the hammer H is thrust leftward as viewed on the drawing of FIG. 5 to bring a rubber type C into contact with the platen PL at the cassette side. Thus, a printing is effected on paper P1 fed from the paper roller LP between the platen PL and type C.

To change over the position of the hammer H, a hammer position change-over instruction is keyed in by key K. In response to the instruction, the signal PS is turned to its high level to disable the gate A1 and enable A2. At the same time, the electromagnet HS is energized to change over the hammer to the position H′. Accordingly, the home position is changed over from h1 to h2, which is discriminated by the printing control PC. Now, the character counter CC is reset and the content of counting is changed. For example, as in the shown embodiment, the new home position h2 which is shifted three characters from the first home position h1 is set for counting. To this end, the character is reset when it has counted three characters and then counting is restarted from 1 provided that AND gate is enabled. In this manner, characters are counted correctly for effecting printing on a sheet of paper P2 laid on the table using h2 as the home position. As previously described, when the paper cassette KK is detached, the hammer is brought to the second position H' for printing characters on the sheet paper P2 on the table.

Figure 7:
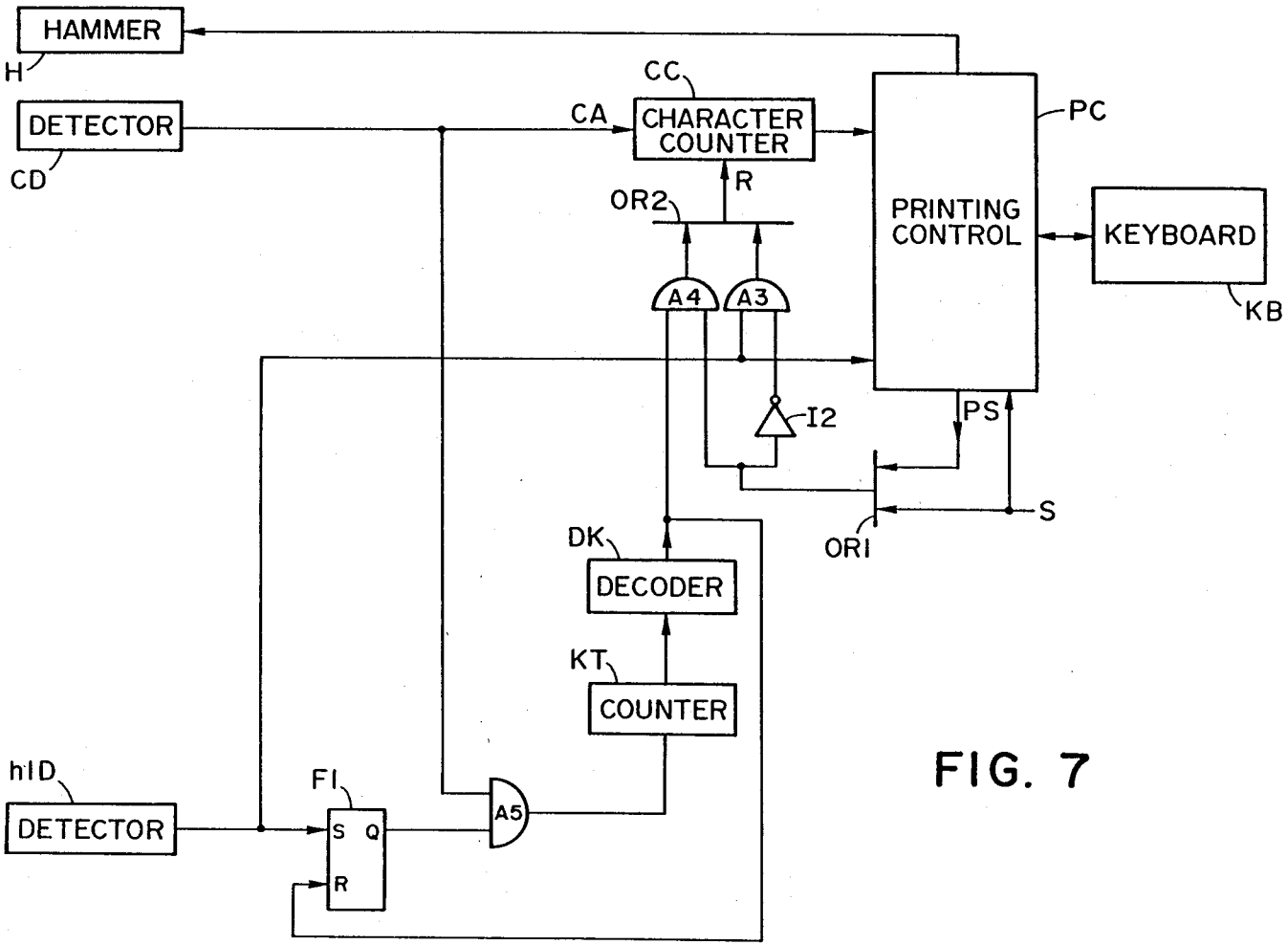

In the embodiment shown in FIG. 6, particular hole h2 and detector h2D have been required to control the changeover of home position. FIG. 7 shows another embodiment in which such particular hole h2 and particular detector h2D are unnecessary and in which the change-over of the home position is controlled by one and single detector h1D.

In FIG. 7, F1 denotes a flip-flop, KT a character pulse counter and DK a decoder for detecting only a predetermined count number which may be, for example, 3.

In the position of the cassette KK being attached as shown in FIG. 5, the hammer H is, as described above, in the position indicated by the solid line and AND gate A3 is enabled whereas A4 is disabled. Therefore, an output signal coming from the detector h1D for home position h1 and passing through the AND gate A3 resets the character counter CC. Thus, in this position, the printer operates in the same printing mode as that of an ordinary type drum printer. The mode is changed over by a printing change-over signal PS or a cassette removal signal S. Namely, by this signal, AND gate A3 is disabled and A4 is enabled so that the character counter CC is now reset in the timing of output from AND gate A4. Since, in this position, character pulses issued after the flip-flop F1 being set by the output of h1D pass through AND gate A5 and then they are counted by counter KT, there is issued an output when the decoder DK detects the predetermined count number which is, in this case, 3. The output is applied to AND gate A4. Since, as previously noted, A4 is enabled at this time, the character counter CC is reset immediately after counting 3 and then it starts counting character pulses CA again from 1. In this manner, there is obtained the type position shifted by three characters from the position for above-mentioned first printing mode. This is the same position as that obtained when the second home position h2 is detected in the previously described embodiment shown in FIG. 6. After this shift of position, the printer operates as a well-known type drum printer and printing on the paper P2 proceeds correctly.

Figure 8:
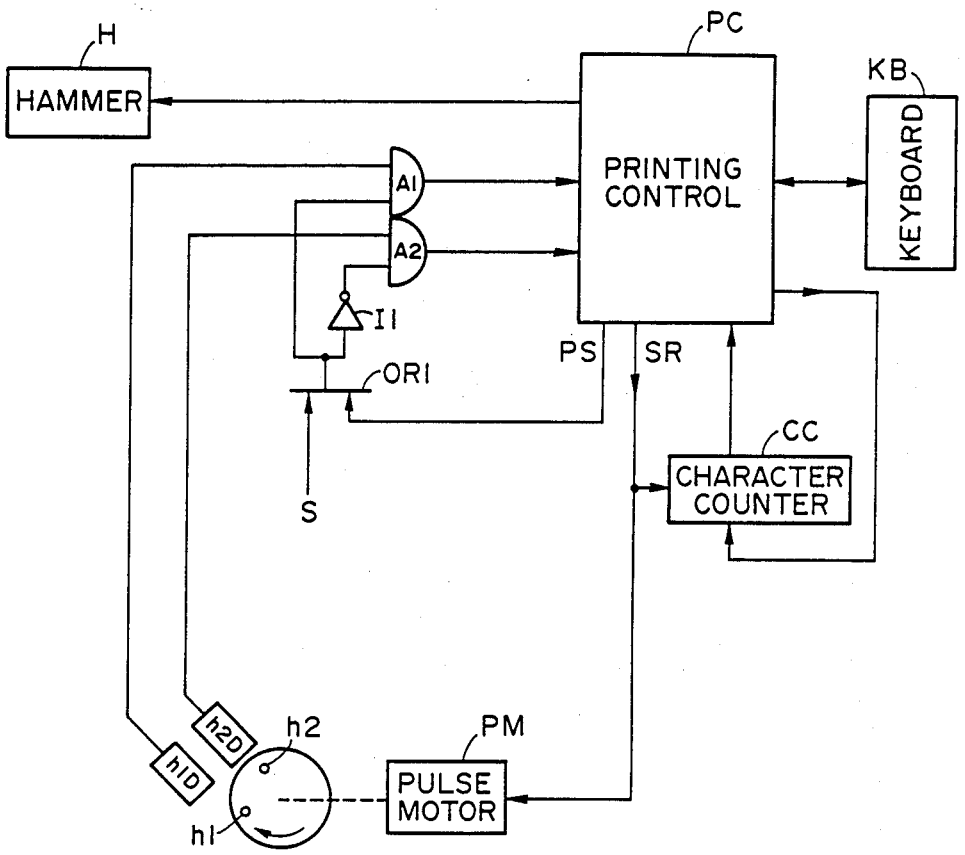
Figure 9:
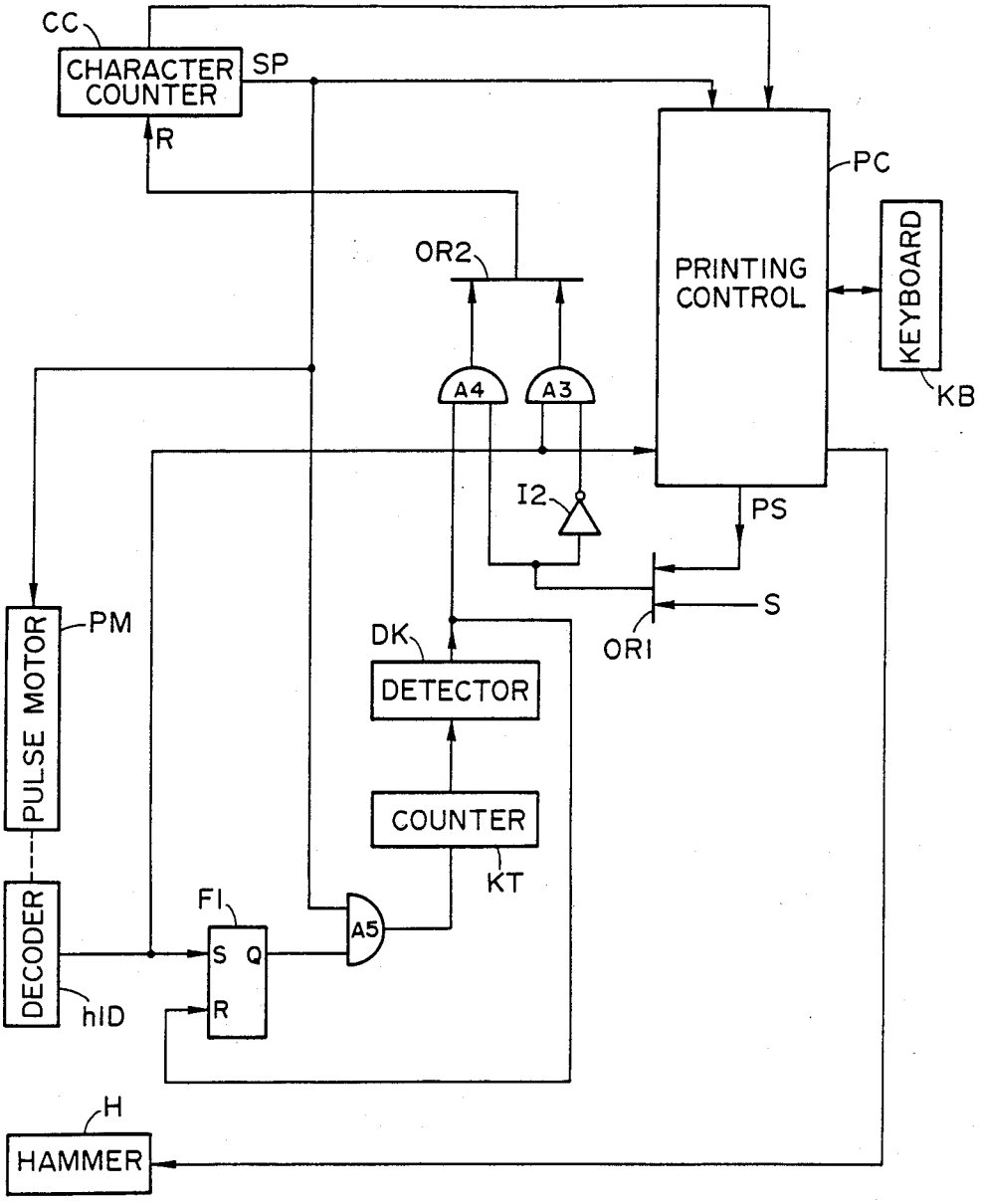

FIGS. 8 and 9 are circuit diagrams showing the circuitry useful for the embodiment shown in FIGS. 3 and 4 wherein a pulse motor is used in place of a DC motor. As well-known to those skilled in the art, when a pulse motor PM is employed, detection of type position becomes unnecessary. Character and position of the type can be detected only by counting the pulses SP for driving the pulse motor PM. Therefore, provision of one and single home position detector is usually sufficient to effect printing.

In the embodiment shown in FIG. 8 like the embodiment shown in FIG. 6, there are provided two detectors h1D and h2D for detecting home positions h1 and h2 respectively. Since reset timing of the character counter CC is changed based on the change-over of the home position from h1 to h2 and vice verse, this embodiment is simple in structure.

In FIG. 9 embodiment, like the embodiment shown in FIG. 7, the change-over of the printing position from one to another is carried out using only one detector h1D. The manner of operation of FIG. 9 embodiment is essentially the same as that of FIG. 7 embodiment.

In all the embodiments described above, printing is carried out using one, single printing hammer (see FIG. 1). The position of printing hammer is changed over from H to H' and vice versa using mechanical or electromagnetical means (not shown in FIG. 1). These embodiments still involve some problems. Firstly, an electromagnet unit HS or the like is required to change over the hammer position. Secondly, there occurs sometimes such a case where printed characters cannot correctly be aligned.

Figure 10:
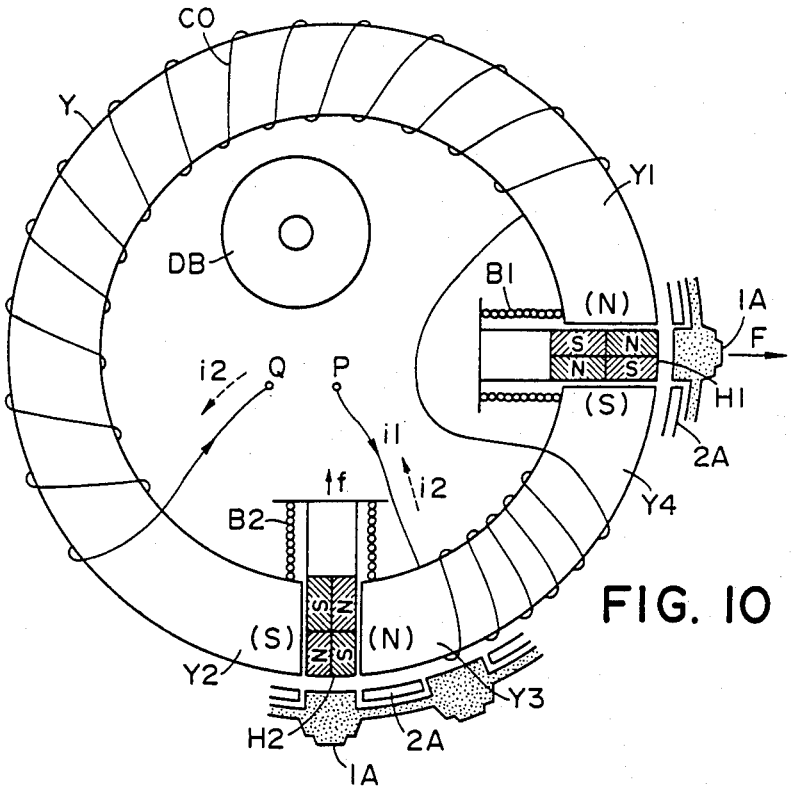
FIG. 10 shows an example of hammer arrangement used in the embodiments.

FIG. 10 shows a hammer arrangement to solve the above problems. According to the embodiment, two different printing hammers H1 and H2 are provided for two different printing positions respectively. These separate hammers are driven by a common coil Co. Since the change-over of the printing position can be made merely by switching over the direction of current flow between the terminals P and Q, a very simple arrangement is obtainable.

In FIG. 10, the printing hammers H1 and H2 are composed of permanent magnets and the hammer driving coil Co is disposed around a ring yoke Y made of soft magnetic material. Since the hollow room of the ring yoke Y constitutes a dead space, an LSI, as previously mentioned, and/or an elongated battery DB as shown in FIG. 10 may be received in the space. The manner of operation of this hammer unit will follow.

When it is wished to perform printing with the printing hammer H1, current i1 is applied to one terminal P of the coil Co. As the current i1 flows from one terminal P to another terminal Q, one end Y1 of the yoke Y adjacent to one side of the hammer H1 becomes an N pole and the other end Y4 of the yoke becomes an S pole. Since the printing hammer H1 has a permanently magnetized multipolar structure as shown in FIG. 10, the N pole of the yoke Y and the S pole of the permanent magnet of hammer H1 attract each other at the side of Y1 and the N pole of the yoke and the N pole of the permanent magnet at the same side repel each other. On the contrary, at the other side Y4, the S pole of yoke Y and the N pole of hammer H1 attract each other whereas the S pole of yoke Y and the S pole of hammer H1 repel each other. As a result, the hammer H1 has a moving force F generated therein.

As for the second printing hammer H2, the current flowing through the coil Co from P to Q produces an S pole at one side Y2 of the yoke and an N pole at the other side Y3. The printing hammer H2 has a permanently magnetized multipolar structure as shown in FIG. 10. Therefore, the S pole at Y2 and the N pole of the hammer H2 attract each other and the S pole at Y2 and the S pole of the hammer H2 repel each other. On the contrary, the N pole of Y3 and S pole of the hammer H2 attract each other and the N pole of Y3 and N pole of the hammer repel each other. As a result, the second printing hammer H2 has a force f generated therein which acts in the direction opposite to printing direction.

In this manner, when the current i1 is applied to the terminal P of coil Co, the hammer H1 generates a printing force F to effect printing on rolled paper or other form of paper at the first printing position. At this time, the second hammer H2 is prevented from operating for printing due to a counter printing force f.

Figure 11:
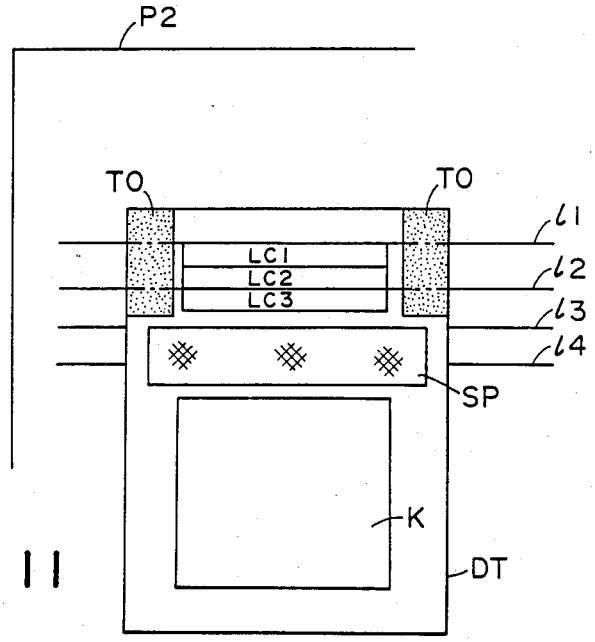
FIG. 11 is a top view of the apparatus shown in FIG. 5.

On the contrary, when the current i2 is applied to the other terminal Q of the coil Co, then the printing force F is generated in the second hammer H2 and the counter printing force f is generated in the first hammer H1. Therefore, in this case, printing is carried out on paper P2 laid on a desk by the second hammer H2. When the hammers H1 and H2 are in their normal waiting position, the interaction of attraction force and other force between the yoke Y and hammers H1, H2 holds the hammers still at the position of minimum magnetic resistance. Therefore, the hammers are returned to their starting positions automatically by the holding force when a currentless state is produced for returning them. To assure the return of the hammers, return springs B1 and B2 may be provided as shown in FIG. 10. When printing is carried out on paper P2 laid on a desk at the second printing position, trouble may occur such that characters are printed in wrong positions because the operator can not easily view the printed characters. Such trouble will be eliminated by making transparent a part TO of the casing of the main body of table computer DT as shown in FIGS. 5 and 11. In FIG. 11, P2 is a ruled paper, l1–l4 are lines thereof and TO is a transparent part. The operator can easily view the lines with which printed characters are to be aligned. Preferably, the second printing position is disposed directly under the liquid crystal display device LC1 as shown in FIG. 5. This arrangement makes it easy for operator to ascertain the correct position of printing. The operator can print characters while viewing the characters appearing on the display device LC1 located directly above the printing position.

The transparent part TO may be an extension of the glass substrate of the liquid crystal display device or may be formed separately by using transparent plastics. The transparent part is preferably provided with a scale mark formed thereon. If necessary, means for ascertaining the printing position may be provided on the body of the desk calculator in addition to the above-mentioned transparent plate. Said printing position ascertaining means may be an index, mark, projections, etc.

Furthermore, as shown in FIG. 5, there may be provided a paper cutter N by extending the free end of the substrate of display device LC1. The paper cutter N may be formed in a simple manner, for example, by toothing on a part of the reflecting plate, or glass substrate. Alternatively, such a paper cutter may be provided on the casing of the type ring unit.

In these years, various electronic apparatus equipped with sound generator have been developed. However, in the case of small-sized electronic apparatus as that described above, it is difficult to find out the space in which the sound generator can be received in. According to the present invention, the dead space between the type ring and the keyboard can be used to receive a speaker SP as shown in FIG. 5. As seen from FIG. 11, the speaker SP can be located at a preferred position to sound.

Figure 12:
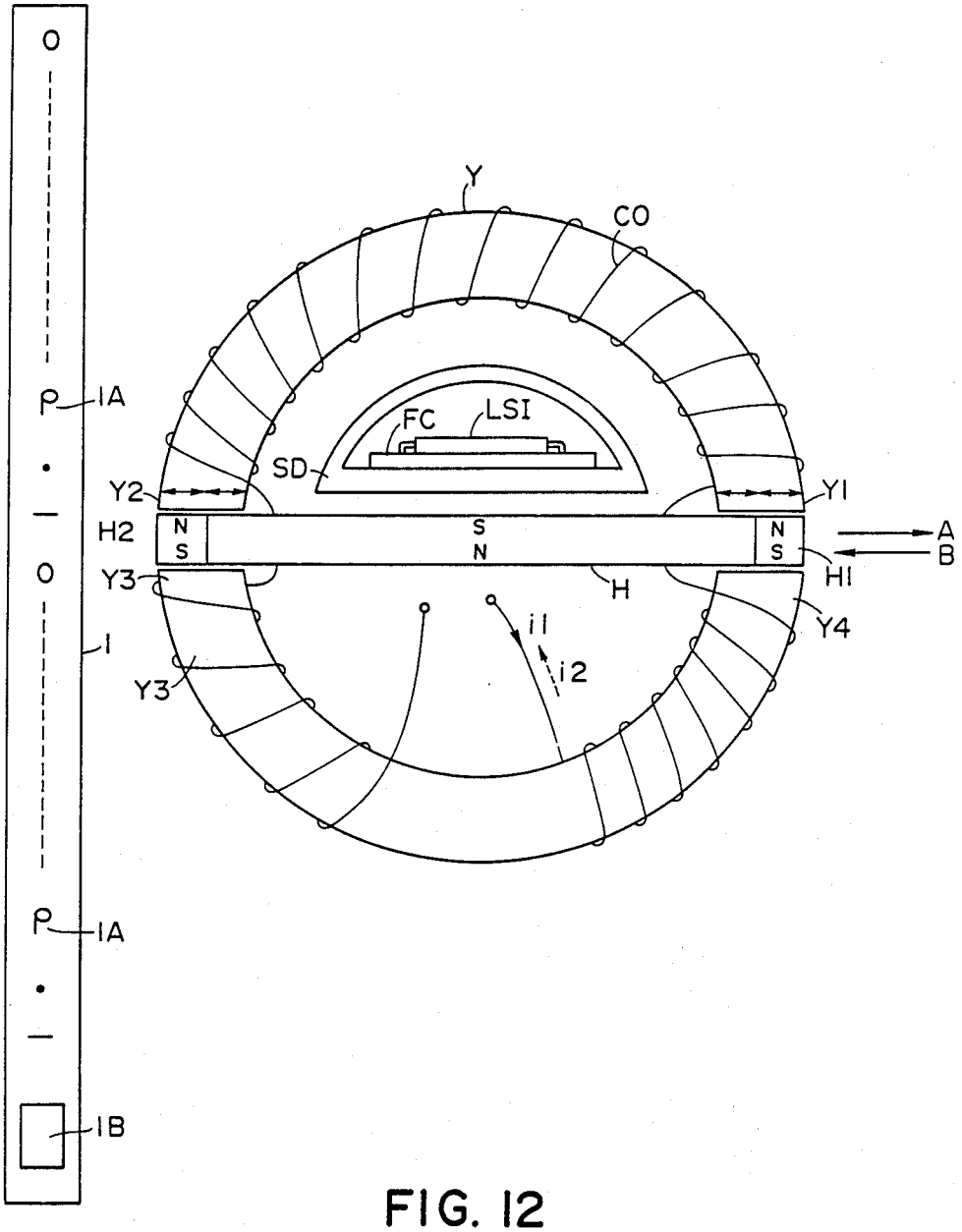
FIG. 12 shows a modification of the hammer arrangement shown in FIG. 10.

FIG. 12 shows a modification of the FIG. 10 embodiment. In FIG. 12, two hammers H1 and H2 are united together to form a unitary hammer body H. The hammer body H contains a magnet embedded and fixed therein. The magnet with multipolarity been magnetized for this purpose. The hammer body H is held by a yoke Y comprising two semicircular parts, that is, yoke Y1–Y2 and yoke Y3–Y4. The hammer body H is disposed sandwiched between the two semicircular yokes, Y1–Y2 and Y3–Y4 with a very small gap being provided therebetween as clearly seen in FIG. 12. A continuous winding Co is coiled around the yoke Y1–Y4.

In FIG. 12, the arrow A indicates a non-printing direction and B indicates a printing direction.

Figure 13A:
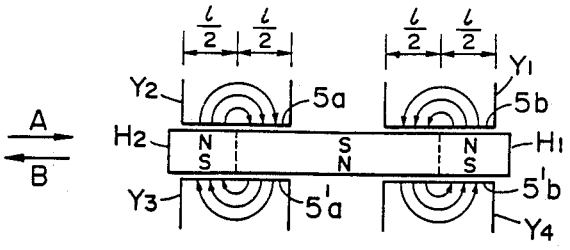
FIGS. 13A, 13B, 13C, 13D and 13E illustrate the manner of operation of the hammer.
Figure 13B:
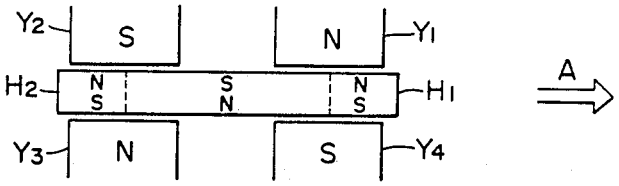

The hammer H is biased toward the direction A when current flows through the coil Co so as to induce the yoke Y1–Y4 to have the polarity shown in FIG. 13B. To bias the hammer H toward B, the yoke must be excited in the manner shown in FIG. 13D.

FIG. 13A shows the positional relation between the yoke and permanent magnet at a still position as well as the state of magnetic fluxes produced therein. As seen from FIG. 13A, the permanent magnet is so formed as to have lines of polarization lying just on the bisectors of the respective end surfaces of the yoke facing the hammer. More particularly, the polarization lines lie on l/2 lines wherein l is the length of the yoke end surface. In this still position, since the magnetic fluxes in the yoke and magnet are in the state shown in FIG. 13A and the attraction forces acting on the hammer by two yoke parts are equal to each other, the hammer is subjected to no biasing force and therefore it remains still. If the hammer is forcedly moved from the still position toward A or B, then the magnetic resistance is increased and a force C is produced which acts in the direction to decrease the magnetic resistance. This force C intends to return the hammer to the still position. Therefore, this still position is very stable and no elastic member such as a spring is required to return the hammer to the still position.

As previously mentioned, when the hammer is to be biased in the non-printing direction A, the current is made to flow through the coil Co around the yoke Y to induce the polarity shown in FIG. 13B. Attraction and repulsion forces between the yoke and magnet at H1 and H2 cause the hammer H to move promptly in the direction of A.

Figure 13C:
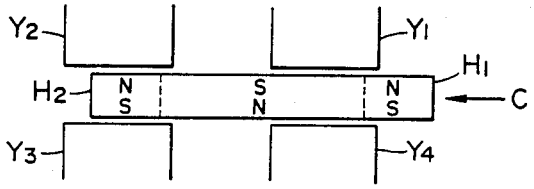

FIG. 13C shows the hammer H which is being biased toward the arrow A and stopped by a stopper not shown. The stopper limits the movement of the hammer and prevents the polarization lines of permanent magnets H1 and H2 from passing beyond the end surface areas 5*a*, 5*b*, 5'*a*, 5'*b*. If the current to the coil Co is cut off in this position, then a returning force C acts on the hammer H to return it to the still position.

Figure 13D:
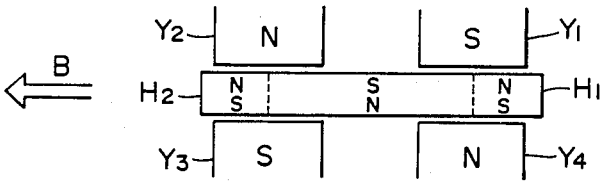

To start printing, a signal is applied to the coil which induces the yoke to have the polarity shown in FIG. 13D. Thereby, the returning force C is increased and therefore the hammer is moved in the direction of B for printing.

Figure 13E:
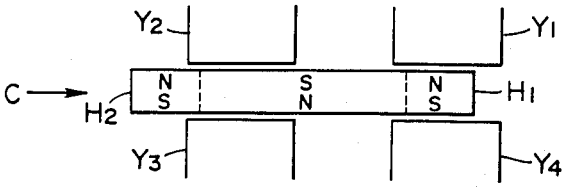

FIG. 13E shows the hammer being in the position in which printing is effected. Within the range where the polarization lines of magnets H1 and H2 are not beyond the areas of yoke surfaces 5*a*, 5*b*, 5'*a*, 5'*b*, the type 1A is brought into contact with a paper P to effect printing. If the current to the coil Co is cut off in this position, the hammer will be returned to the still position at once by the action of returning force C.

In the modification shown in FIG. 12, the hammer H is used to effect printing in both directions A and B nearly at the same time. In this case, the type belt 1 is doubled as compared with a common one in the number of types contained in the belt. Since the same content of print can be obtained on two separate paper sheets nearly at the same time, this modification is preferably particularly when printing is desired on a receipt sheet for customer and on a rolled paper for keeping at the same time as in the case of cash registers in shops. Printing on a receipt paper is possible also using the embodiment shown in FIG. 1. In the apparatus shown in FIG. 1, the pinch roller 7 is supported elastically by a spring 8 and therefore the pinch roller is easily retractable for insertion of a receipt paper to make printing thereon. In this case, the receipt paper inserted into the printing position is laid on the rolled paper P and therefore the thickness of paper existing at the printing position is somewhat increased. However, the printing system used in the apparatus is of the type in which printing is effected by bringing the ink on the type into contact with printing paper, such a small variation in paper thickness never affects the printing effect. Printing can be performed without any trouble even in this case. This is an important advantage of the embodiment.

While the embodiment shown in FIG. 12 has a hammer body H with which printing can be carried out on two separate kinds of printing paper nearly at the same time at two printing positions spaced from each other by 180°, the angular distance between two printing positions may be changed as desired. For example, by changing the angular distance to 90° there are obtained two printing positions as in the embodiment shown in FIG. 10 where the first and second printing directions from 90°. To this end, the center part of the hammer body H in FIG. 11 is formed by using a flexible material. At the center, the hammer body H is bent about 90° and there are provided guide members along which the curved hammer body is slide movable. If the hammer body is bent not 90° but 110°–120°, there is obtained a further preferred arrangement of printing positions. In this case, the horizontal hammer arm can be inclined upward about 20°–30° as in the case of the embodiment shown in FIG. 1, which allows the operator to easily and conveniently view the printed characters. At the same time, with the vertical hammer arm of the curved hammer body H, printing can be carried out also on a sheet of paper laid on a desk at the second printing position spaced from the first printing position by an angle of 110° to 120°. For embodiments as shown in FIG. 12, also the previously mentioned projection 1B may be used to feed the printing paper. By reversing the rotational direction of the type drum, the aimed double printing can be performed. Of course, a known and conventional paper feed mechanism may be used for these embodiments.

Figure 14:
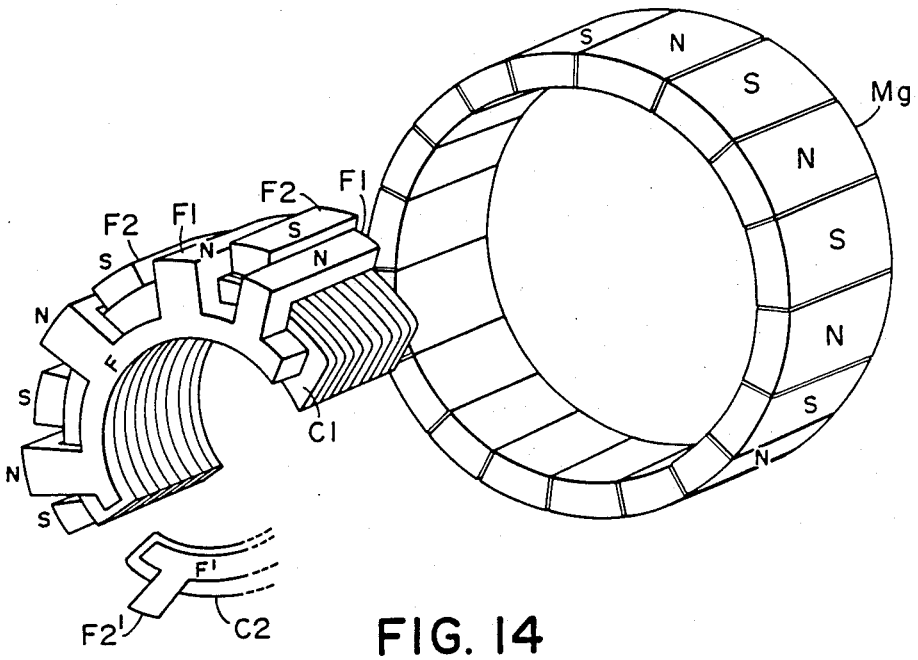
FIG. 14 shows a detailed form of a part of the apparatus shown in FIG. 1.

FIG. 14 shows a form of outer-rotor pulse motor corresponding to the embodiment shown in FIG. 2.

Figure 15:
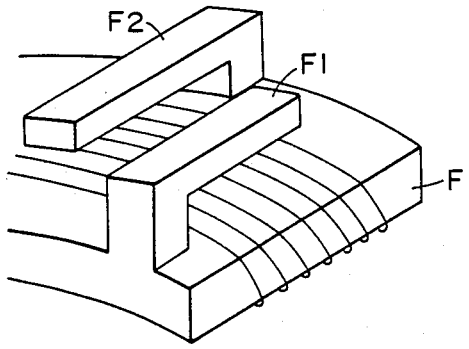
FIG. 15 is a perspective view of a portion of the apparatus shown in FIG. 14.
Figure 16:
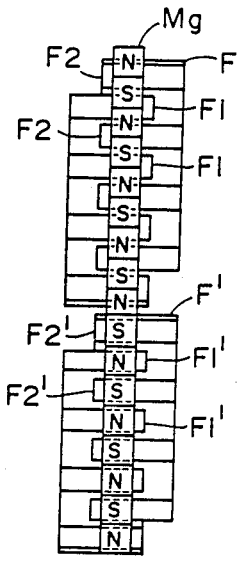
FIG. 16 is a developed view of the part shown in FIG. 14.

In FIG. 14, the ring-shaped member designated by Mg is a permanent magnet having a number of N and S poles alternately arranged on the ring. In the shown embodiment, the length of each one pole corresponds to two types. Therefore, to make 32 (thirty two) characters, 8(eight) S poles and 8(eight) N poles are arranged into a ring. Within the ring, two pairs of comblike yokes F1–F2 and F1′–F2′ are disposed in mesh with each other. Within the yokes there are disposed coils C1 and C2 respectively. The first pair of yokes F1–F2 forms a unitary semicircular yoke structure F as shown in FIG. 15. Similarly, the second pair of yokes F1′–F2′ forms another unitary semicircular yoke structure F′ which is the same as F in structure. These two yoke structures F and F′ are disposed opposed to each other with one being ½ pole shifted from the other as shown in FIG. 14. FIG. 16 is an developed view thereof.

Figure 17:
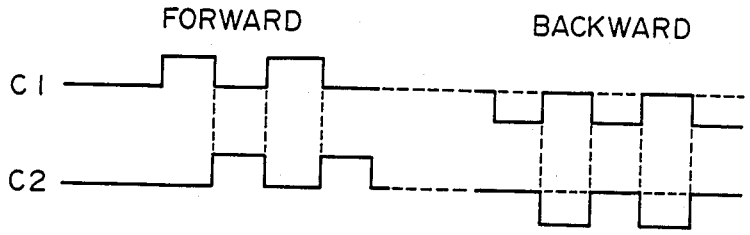
FIG. 17 shows a drive waveforms.
Figure 19:
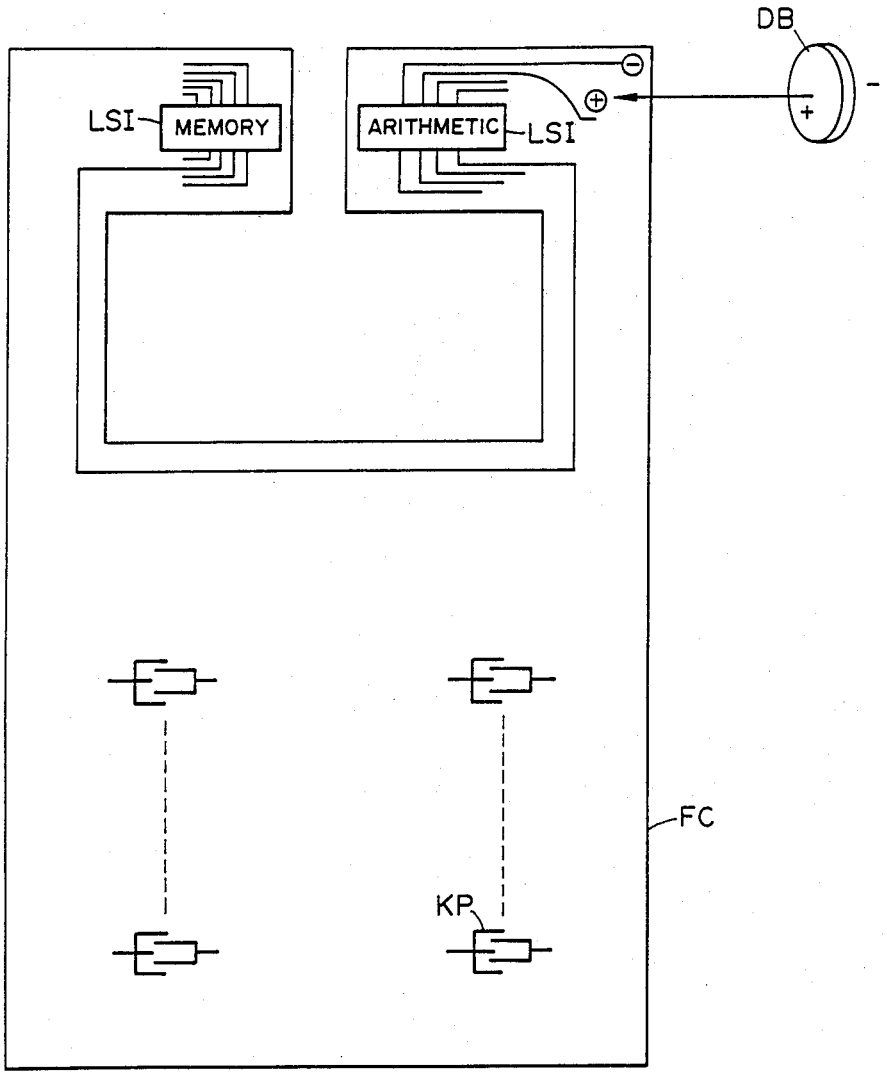
FIG. 19 shows a example of flexible printed circuit board used in the embodiment.

When current is introduced into the coil C1 in a certain direction as shown in FIG. 17, F1 becomes an N pole and F2 an S pole. The N pole of the outer-rotor permanent magnet and N pole of F1 repel each other whereas the S pole of the magnet and N pole of F1 draw each other. The S pole of F2 and N pole of the magnet attract each other whereas the S pole of F2 and S pole of the magnet repel each other. As a result, the outer-rotor permanent magnet advances one step corresponding to ½ pole downward as viewed on the drawing of FIG. 16.

Similarly, when the current is introduced into C2 in the same direction as above subsequently to the above ½ pole advance, F1′ becomes an S pole and F2′ an N pole. The attraction and repulsion forces generated between the permanent magnet and F1′, F2′ at this time cause the ring magnet to advance further ½ pole distance. In this manner, the ring magnet continues rotating intermittently while repeating the above motion. When it is wished to reverse the rotational direction, the current is introduced into the coils C1 and C2 in the direction opposite to the above so as to make F1′ an N pole and F2′ an S pole.

Figure 18:
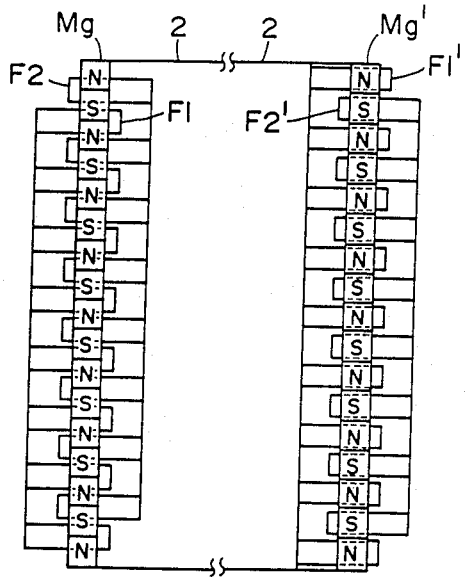
FIG. 18 is a view similar to FIG. 16 and showing another form of the part.

FIG. 18 shows another embodiment. In this embodiment, coils C1, C2, permanent magnets Mg, Mg′, yokes F1, F1′ etc. as shown in FIG. 14 are arranged at the both sides of the type ring symmetrically to obtain a higher torque than in the abovedescribed embodiment.

While the invention has been particularly shown and described with reference to preferred embodiments thereof, it will be understood by those skilled in the art that the foregoing and other changes in form and details can be made therein without departing from the spirit and scope of the invention.

What we claim is:

1. A printer comprising:

a type wheel unit including (1) a cylindrical supporting member having a plurality of holes therearound, (2) a type belt having a back surface thereof provided with a plurality of projections and a front surface having a plurality of types each corresponding to one of said projections, said type belt being disposed around said supporting member so that each said projection is engaged with one of said holes around said supporting member, and (3) power transmission means mounted on an end of said type wheel unit and surrounding said type wheel unit;

an ink roller for applying an ink to the types and disposed to avoid said power transmission means;

hammer means accommodated within said type wheel unit for striking said projections of said type belt to project the corresponding type away from said supporting member and toward a printing paper;

an outer-rotor type pulse motor mounted on a rotating axis of said type wheel unit at said type wheel end with a rotor of said motor fixed to said supporting member for rotation thereof;

a paper feed roller arranged to intermittently contact said power transmission means to provide a force for feeding a printing paper so that said outer-rotor type pulse motor can directly rotate said type wheel unit and said type wheel can rotate said paper feed roller;

wherein said power transmission means includes a resilient member having a projection formed on an outer circumferential portion thereof, and wherein said resilient member comprises a material having a frictional force sufficient to drive said paper feed roller.

2. A printer according to claim 1, wherein said power transmission means is formed on said type belt at an end of said supporting member.

3. A printer according to claim 1, wherein said paper feed roller feeds the printing paper once for each revolution of said type wheel unit through the contact with said power transmission means.

4. A printer according to claim 3, further comprising a platen for holding the printing paper at the position where said hammer means projects said types, wherein said paper feed roller and said power transmission means are arranged at the same end of said type wheel unit.

* * * * *

UNITED STATES PATENT AND TRADEMARK OFFICE

CERTIFICATE OF CORRECTION

PATENT NO. : 4,881,833

DATED : November 21, 1989

INVENTOR(S) : MITSUAKI SEKI ET AL.

It is certified that error appears in the above-identified patent and that said Letters Patent is hereby corrected as shown below:

ON THE TITLE PAGE,
AT [73] ASSIGNEES:

"Cannon Kabushiki Kaisha; Cannon Denshi Kabushiki Kaisha, both of Tokyo, Japan" should read --Canon Kabushiki Kaisha; Canon Denshi Kabushiki Kaisha, both of Tokyo, Japan--.

COLUMN 2

Line 41, "printing paper P2" should read --printing paper P,--.
Line 53, "rubber silicone" should read --rubber, silicone--.

COLUMN 3

Line 21, "LC3" should read --LC3,--.

COLUMN 8

Line 1, "been" should read --has been--.

UNITED STATES PATENT AND TRADEMARK OFFICE

CERTIFICATE OF CORRECTION

PATENT NO. : 4,881,833

DATED : November 21, 1989

INVENTOR(S) : MITSUAKI SEKI ET AL.

It is certified that error appears in the above-identified patent and that said Letters Patent is hereby corrected as shown below:

COLUMN 9

Line 31, "from" should read --form--.

COLUMN 10

Line 31, "abovedescribed" should read --above-described--.

Signed and Sealed this

Fifteenth Day of October, 1991

*Attest:*

HARRY F. MANBECK, JR.

*Attesting Officer*

*Commissioner of Patents and Trademarks*